US007438080B2

(12) United States Patent
Johnson

(10) Patent No.: US 7,438,080 B2
(45) Date of Patent: Oct. 21, 2008

(54) SYSTEM AND METHOD FOR DEWATERING AN AREA

(76) Inventor: Garrett Johnson, 2700 International Blvd., Suite 700, Virginia Beach, VA (US) 23451

( * ) Notice: Subject to any disclaimer, the term of this patent is extended or adjusted under 35 U.S.C. 154(b) by 57 days.

(21) Appl. No.: 11/732,233

(22) Filed: Apr. 3, 2007

(65) Prior Publication Data

US 2007/0227049 A1 Oct. 4, 2007

Related U.S. Application Data

(60) Provisional application No. 60/789,000, filed on Apr. 4, 2006.

(51) Int. Cl.
*B67D 5/54* (2006.01)

(52) U.S. Cl. ..... 137/209; 405/36; 417/86; 417/118

(58) Field of Classification Search ..... 137/13, 137/159, 169, 356, 363; 405/36, 53; 417/86, 417/90, 108, 109, 118
See application file for complete search history.

(56) References Cited

U.S. PATENT DOCUMENTS 4,720,210 A 1/1988 Stoner et al.
5,282,487 A * 2/1994 Timpany ..... 137/8
5,364,208 A 11/1994 Taguchi
5,507,601 A 4/1996 Tagushi
5,544,983 A 8/1996 Taguchi
5,611,671 A 3/1997 Tripp, Jr.
6,224,342 B1 5/2001 Russell et al.
6,640,470 B2 11/2003 Chesner et al.
2006/0022470 A1 2/2006 Johnson

* cited by examiner

*Primary Examiner*—John Rivell
*Assistant Examiner*—Craig M Schneider
(74) *Attorney, Agent, or Firm*—Williams Mullen; M. Bruce Harper

(57) ABSTRACT

A system and method for dewatering an area in which a catch basin is situated within the area to collect water and conduit conveys the collected water to an elongated discharge chamber having a muzzle at a distal end in communication with a desired outfall body and a substantially closed proximal end. Compressed air released into the proximal end of the discharge chamber forcibly discharges water out of the discharge chamber via the muzzle and into the outfall body to dewater the area. A vent permits escape of air as the discharge chamber fills. Backflow prevention valves maintain discharge out of the muzzle and prevent any water from the outfall body from flowing back into the discharge chamber.

12 Claims, 3 Drawing Sheets

SYSTEM AND METHOD FOR DEWATERING AN AREA

CROSS REFERENCE TO RELATED APPLICATIONS

The present application claims priority from U.S. Provisional Application Ser. No. 60/789,000, filed Apr. 4, 2006.

FIELD OF THE INVENTION

The present invention relates to a dewatering system and method. More particularly, the present invention is a surface water collection and pumping system employing the release of compressed gas through a discharge chamber.

BACKGROUND OF THE INVENTION

Storm water systems are generally designed to provide adequate dewatering of surface areas while addressing related issues such as protection of watershed water quality, erosion, etc. Integral within any system plan or design is an assessment of the topography of the site for grading within the area of concern. Of course, regions of consistently flat topographies, such as the low-lying areas of the city of New Orleans, provide particular challenges to storm water removal. In such topographies, pumping stations may be required for dewatering, transporting water both horizontally and vertically.

In situations where a dewatering system is responsible for large surface areas, the associated pumping systems must be capable of pumping large volumes of fluid. Such larger systems typically require robust pumping stations having sizable pumps, motors, power supplies, supporting piping, and other equipment. Such pumping stations have been used in a variety of circumstances, such as the evacuation of seepage from low elevation areas, removal of storm drainage, transfer of sewage, maintenance of canal systems, etc. Some pumping stations may be temporarily installed for the pumping of mines or deep wells. Somewhat similar dewatering systems may be found on ships, sometimes using bilge pumps with catch basins, and other times as a bilge evacuation or fire main eductor system.

In general, there are two types of pumping stations seen in civil infrastructures: wet-pit and dry-pit. In a wet-pit station, submersible pumps are immersed in water contained within a sump or wet well. Submersible pumps have been generally preferred for storm water removal. Dry pit stations provide both a wet well and a dry well. The wet well stores the water to be pumped, which is transferred to the dry well by piping. The two stage process of dry pit stations make them more expensive, but enables maintenance of the pump without removal from the wet well. The pumps conventionally used in these stations may be classified by the type of flow, such as axial flow, radial flow, or mixed flow. The type of flow indicates the type of device used to impart energy to the water. Axial flow pumps typical use propellers to create a low pressure or head with a high volume flow in the direction of the propeller axis. Radial flow pumps typically use impellers to create a high pressure or head with a centrifugal flow about the axis of the impeller. Mixed flow pumps use a combination of the above two types of flow. Each of these types of pumps requires a motor to drive the propeller or impeller through an axle or drive shaft.

Of course, both of the above approaches involves considerable infrastructure. Another hazard that the conventional pumping systems face is the presence of sediment, debris, sand, or other such objects within the fluid to be pumped.

Sediment can damage a pump propeller or impeller. Most pumps stations require a significant filtering system to clean the fluid prior to it being pumped. However, filters increase the resistance to flow, causing the pump to work harder and the motor to consume greater power for the volumetric flow pumped. In some cases, filters may become clogged. In general, conventional pumps may require additional maintenance and expense of operation when used in an unclean environment. Unfortunately, an unclean environment is typical for most dewatering systems. Filters and grates designed to protect pumps are common problems for dewatering systems.

Another aspect is the need for the supporting systems of a pumping system. Most conventional pumping systems require an ongoing supply of power to maintain operation of the motors driving the pumps. Even eductors require a minimum level of fire main pressure and flow in order to generate a vacuum at the intake port of the eductor. Yet in the conditions requiring dewatering, such as flooding caused by storms, or a flooding casualty aboard ship, the power supply may be unreliable.

Some other approaches to pumping fluids have involved the use of air lift pumps or equivalent structures. Air lift pumps commonly create a multiphase mixture of gas and fluid within a vertical pipe, the mixture having a lower density than the surrounding fluid. The difference in density can induce the mixture to travel up the vertical pipe and ultimately to discharge. Other efforts involve creating a pressure differential between vessels in a closed system to move fluid from a high pressure vessel to a lower pressure vessel. These structures are not well adapted to the environments common in large volume, open system dewatering, with large surface areas, debris laden water, the need for horizontal transport, reliability, independent power sources, etc. Conventional air lift pumps require inlets placed at considerable depth below the water surface and function primarily in the vertical so that the multiphase mixture will be sustained as it rises. Further, air lift pumps are generally inefficient and closed pressure vessel systems are expensive and complicated.

Accordingly, it would be useful to have a dewatering system that is capable of handling a large volume of fluid, capable of pumping fluid contaminated with sediment, and capable of operating without a dedicated motor with available power.

BRIEF SUMMARY OF THE INVENTION

The present invention is directed to a dewatering system having a catch basin adapted to collect water from an area of concern and conduit to convey the collected water to an elongated discharge chamber having a muzzle at a distal end in communication with a desired outfall body and a substantially closed proximal end. The muzzle includes a first backflow prevention device to prevent backflow from the outfall body into the discharge chamber while permitting discharge from the discharge chamber via the muzzle. The conduit, being interposed between the catch basin and the discharge chamber to provide fluid communication from the catch basin to the discharge chamber includes a second backflow prevention device to ensure water communication from the catch basin solely in a direction to fill the discharge chamber. The discharge chamber further comprises a vent to enable the escape of air from the discharge chamber as water fills the discharge chamber. This vent may include a valve to prevent release of water through the vent as the discharge chamber discharges.

An anchor secures the discharge chamber in a desired orientation and depth with respect to the outfall body and the catch basin. Preferably, the discharge chamber includes substantial horizontal travel for the discharged water, as described herein, enabling the water to clear the area of concern.

For the purpose of discharging water form the discharge chamber, a supply of compressed air is fluidly interconnected with the proximal end of the discharge chamber. A control valve may be situated in fluid communication with the supply of compressed air for operatively controlling the flow of compressed air into the discharge chamber. Thus, actuation of the control valve releases compressed air into the proximal end of the discharge chamber to forcibly discharge water out of the discharge chamber via the muzzle and into the outfall body to dewater the area. This supply of compressed air may include an air compressor fluidly interconnected with the supply of compressed air.

The discharge chamber may be configured for manual or automated discharge. Automated discharge may require a control system having sensors to measuring the level of water within the discharge chamber and a controller to actuate the control valve when the level of water within the discharge chamber is at a desired level.

In many embodiments, it is contemplated that the proximal end of the discharge chamber may be positioned at a depth below the catch basin and the muzzle, such that the discharge chamber may fill by gravity drain. In some configurations, the dewatering system may include a fill pump fluidly interconnected within the conduit, configured with its input from the direction of the catch basin and its output in the direction of the discharge chamber, such that upon operation the pump will assist in filling the discharge chamber.

The present invention includes a method of dewatering a surface, having the steps of providing at least one catch basin within an area adapted to collect surface water from an area, providing an elongated discharge chamber with a distal end muzzle in communication with a desired outfall body and a substantially closed proximal end, wherein the proximal end may optionally be positioned at a depth below the catch basin and the muzzle includes a first backflow prevention device to prevent backflow from the outfall body into the discharge chamber while permitting discharge out of the muzzle from the discharge chamber, providing piping or conduit between the catch basin and the discharge chamber for fluid communication from the catch basin to fill the discharge chamber, wherein a second backflow prevention device is interposed between the catch basin and the discharge chamber within the conduit to ensure water communication from the catch basin solely in a direction to fill the discharge chamber, providing a vent to the discharge chamber to enable the escape of air from the discharge chamber as water fills the discharge chamber, anchoring the discharge chamber in a desired orientation and depth with respect to the outfall body and the catch basin; and when the water in the discharge chamber reaches a desired level, releasing compressed air into the proximal end of the discharge chamber to forcibly expel the water out of the muzzle and into the outfall body to dewater the area.

DETAILED DESCRIPTION OF THE INVENTION

Figure 1:
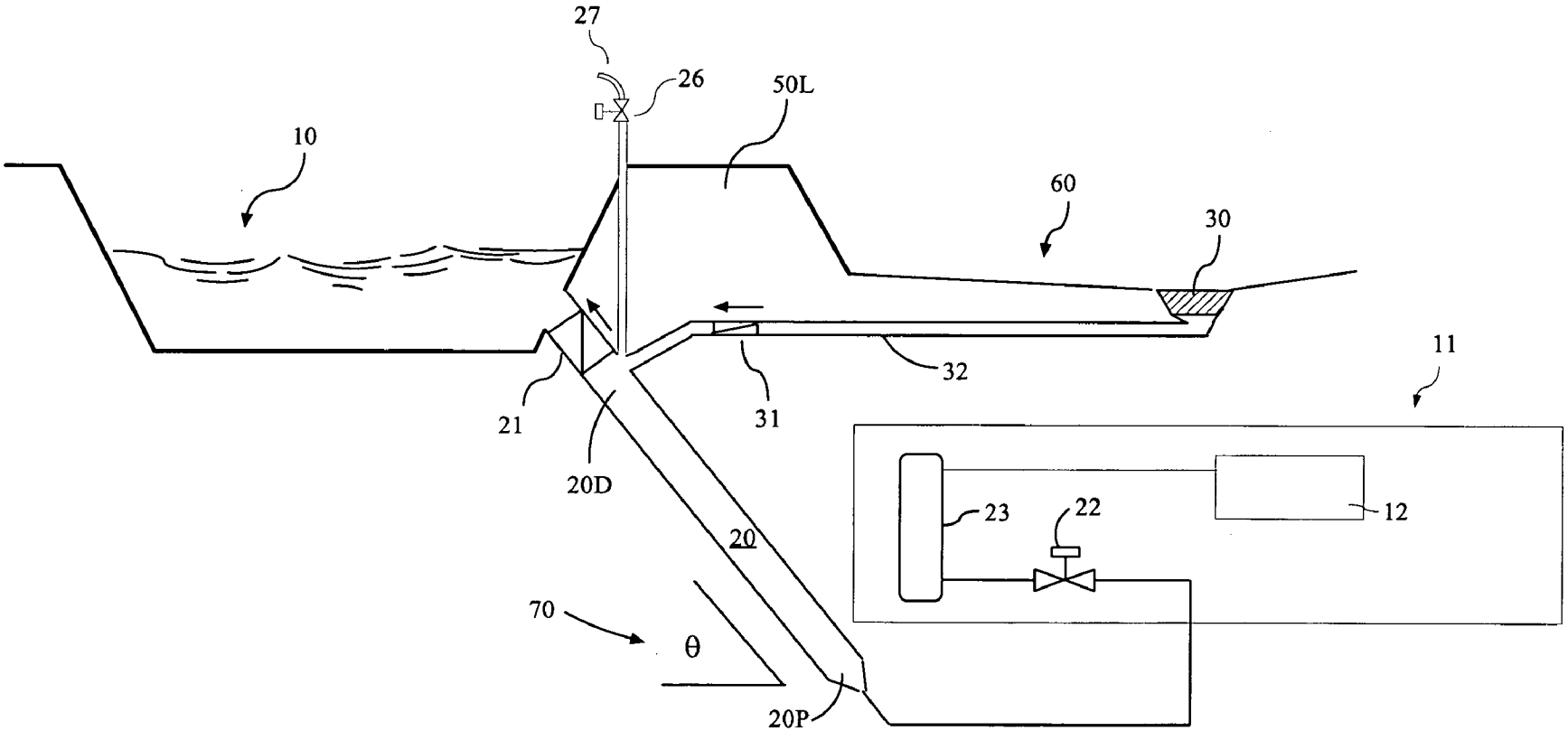
FIG. 1 is a side view schematic of an embodiment of the present invention for dewatering an area behind a levee.

The present invention is a dewatering system. The system collects surface water from an area and communicates this water to a discharge chamber, for further travel or communication to an outfall body. When the discharge chamber is filled to a desired level, defined in part by the volume of the chamber, then compressed gas may be released into the discharge chamber to force the water out of the chamber and into the outfall body. Thus, the present invention dewaters by periodically discharging discrete units or volumes of water from a discharge chamber.

The discharge chamber of the present invention may take a variety of forms. In one embodiment, the discharge chamber may be in the form of a modified wave cannon, which heretofore has been used to generate artificial waves or other recreational effects. This form of artificial wave generation technology was disclosed in U.S. Pat. No. 5,833,393 to Carnahan et al., which is hereby incorporated by reference. This technology has sometimes been referred to as a wave cannon because it is an elongated discharge chamber or barrel having a muzzle at a distal end and a substantially closed proximal end. A wave cannon is configured to generate waves when compressed air is released into the proximal end of the wave cannon, forcing water out of the muzzle and into a body of water or wave pool to create swells or waves. Because of the nature of compressed gas, wave cannons may transfer large amounts of energy while having unobtrusive or sub-grade infrastructure.

Thus, one embodiment of the present invention is a dewatering system having a modified wave cannon as a discharge chamber. Of course, the present invention is not directed to creating waves, and may be adaptable to a wide variety of different configurations of discharge chambers and systems. For example, a pumping station for pumping storm water may use several substantially horizontal discharge chambers that discharge without synchronization, even though driven by a common compressed air source. Notably, the cross section of the discharge chamber of the present invention may take a wide variety of geometric shapes or forms, so long as it is effective as an elongated chamber for discharging water, having a muzzle or substantially open distal end and a substantially closed proximal end.

Any number of discharge chambers may be used in the present invention, although two or three pumps may be desirable depending on the volumetric flow rate and level of reliability needed. The area of coverage, the size of the discharge tube, the frequency of discharge, volume or availability of compressed gas, and the pressure of the compressed gas will all contribute to the volumetric discharge rate. In the event that small quantities of surface water are expected, a primary discharge chamber with a single installed back up discharge chamber may be appropriate. Because of the simple design of the present invention, the discharge chamber is one of the more durable components. Thus, optionally, redundant supply lines, storage accumulators, and compressed gas systems may be more of a reliability concern than the presence of installed back up discharge chambers, which could reduce cost. In the event of a power loss, the compressed air may be provided by accumulator storage tanks or generated locally by independent emergency compressors. Preferably, automatic backup diesel engines with emergency fuel supplies may operate air compressors and generate control power;

alternatively, a system may use a backup battery driven compressor, solar powered compressor, etc.

Preferably, the discharge chamber is configured for the avoidance of low water volume flow in which a substantial quantity of air escapes from the discharge chamber without having forced water to discharge. It is contemplated that a large volume slug flow driven by a gas bubble formed by the released air could produce an effective discharge of water. Of course, the flow regime will depend on a variety of fluid properties, including the size and shape of the discharge chamber, the volume and pressure of the released air, and the desired flow rate. Each release of air is a discrete admission of air into the discharge chamber, in which the expansion of the air corresponds to a discrete discharge of water volume analogous to the firing of a cannon.

FIG. 1 illustrates an example of the present invention. A drainage field, culvert, or body of water is selected to receive the discharge, here designated "outfall body" 10; this outfall body 10 is constrained by levee 50L from flooding area 60 of the surface to be dewatered. Catch basin 30 is preferably located at a low point in the topography of area 60 and collects runoff water or any water from outfall body 10 that might have overtopped levee 50L. In this embodiment, water collected in catch basin 30 gravity drains along conduit 32, past drainage check valve 31, and into discharge chamber 20. At the distal end 20D of discharge chamber 20 is muzzle check valve 21 (e.g., a unidirectional check or flapper valve) to prevent back flow from the outfall body 10 into discharge chamber 20.

Note that along discharge chamber 20 (i.e., moving from proximal end 20P to distal end 20D) there is substantial horizontal travel for the discharged water. This enables the water to clear levee 50L, even though this example shows angle 70 or slope in the direction of distal end 20D. Substantial horizontal travel along discharge chamber 20 may be considered for the present invention travel other than predominantly or purely vertical movement. Of course, the more vertical configurations with steeper slopes would provide less relative horizontal travel. Further, a more vertical configuration would require greater energy to discharge a unit volume of water, and thus would likely be less efficient.

It is contemplated that discharge chamber 20 may be anchored underground at a desired orientation and depth with respect to the outfall body 10 and the catch basin 30. The distal end 20D high point of discharge tube 20 may be vented as shown by vent 27. Optional vent isolation valve 26 may be open for venting during filling of discharge chamber 20, and closed during the discharge or firing of discharge chamber 20.

A supply of compressed air is fluidly interconnected with the proximal end 20P of the discharge chamber 20. This supply may take a variety of embodiments. For example, compressed air may be stored in accumulator 23. When discharge chamber 20 is filled with water, compressed air may be released into a substantially closed proximal end of discharge chamber 20 by actuation of control valve 22 (i.e., preferably with vent isolation valve 26 closed). Those skilled in the art will acknowledge that water level indicators may be used within discharge chamber 20, and that commercially available controls and actuators may be used with control valve 22 for automated operation. Compressed air facility 11 may include compressor 12 for charging of accumulator 23. As noted above, compressor 12 may be an emergency diesel compressor, battery driven compressor, solar powered compressor, etc.

Optionally, the discharge of vent 27 may be directed to a low pressure reclamation system (not shown) wherein the head of water pressure filling discharge chamber 20 may be used to establish an initial pressurization caused by air escaping from discharge chamber 20. Such low pressure air may then be dehumidified and supplied to compressor 12 for final pressurization, as needed.

Figure 2:
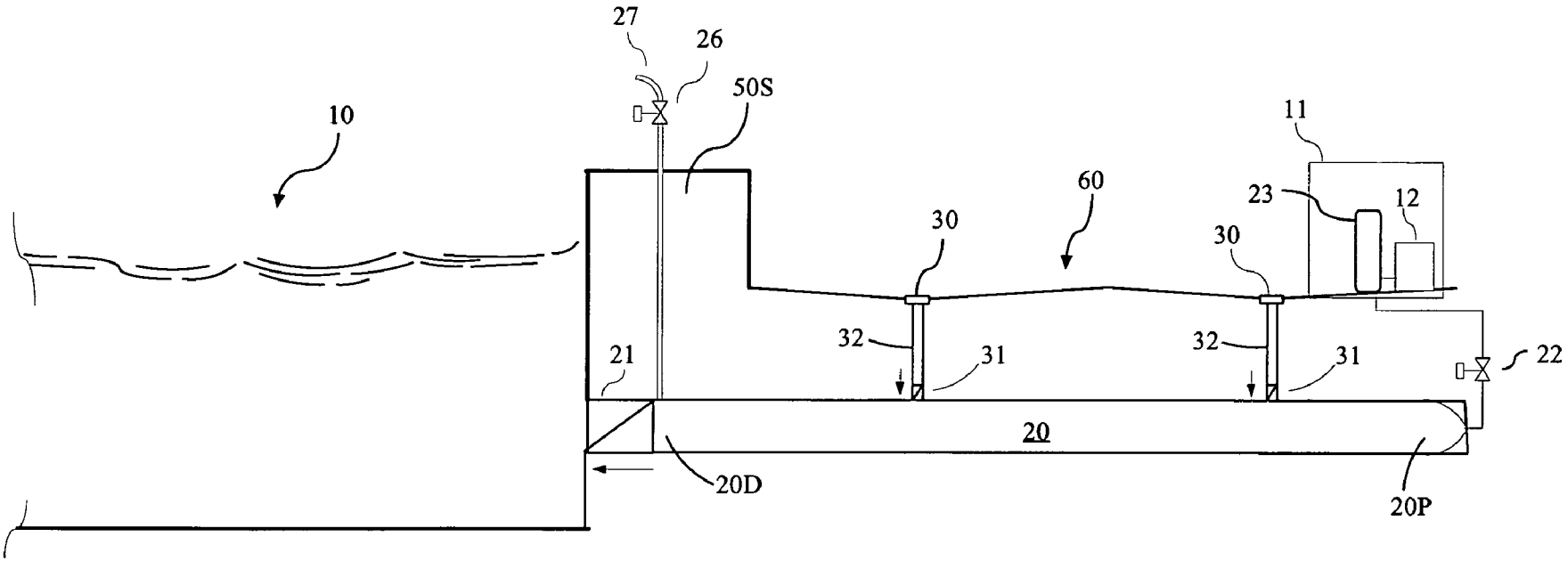
FIG. 2 is a side view schematic of an embodiment of the present invention for dewatering an area behind a sea wall.

FIG. 2 shows another embodiment of the present invention. In this example, outfall body 10 is separated from area 60 by seawall 50S. Although drainage area 60 is shown below the level of outfall body 10, the present invention is also contemplated for circumstances in which drainage area 60 may be above the level of outfall body 10. A closing spring bias for muzzle check valve 21 may be used to enable discharge chamber 20 to fill prior to discharge, if desired. Such a design could accommodate circumstances in which the outfall body 10 water level may vary from below the level of area 60 to above the level of area 60. Alternatively and more simply, discharge chamber 20 may simply drain by gravity into outfall body 10 when water level in outfall body 10 is below area 60.

Preferably, proximal end 20P of discharge chamber 20 is situated below area 60 to permit gravity drainage. Although gravity filling of discharge chamber 20 is preferable, it is not required. In such alternate embodiments without gravity systems, conventional drain pumping system may be used. That configuration may be desirable as a high water level backup for use in the event of extraordinary flooding. Thus, the use of additional pumps to fill discharge chamber 20 is feasible; however, that approach may re-introduce some of the disadvantages overcome by the present invention. Because the water level over drainage area 60 may vary—certain embodiments may include discharge chambers 20 at various levels or elevations for dewatering at different locations or topographies over drainage area 60.

For the example in FIG. 2, water from drainage area 60 passes through surface storm drains or catch basins 30 and past drainage check valve 31 into discharge chamber 20. As discussed above, if the distal end 20D of discharge chamber 20 is above the level of outfall body 10 at any time (e.g., a low tide or early in a flood), and discharge chamber 20 contains water, then the water may freely pass from catch basin 30 through conduit 32 into discharge chamber 20 and then into outfall body 10. For embodiments with discharge chamber 20 consistently below the level of outfall body 10, discharge chamber 20 is preferably oriented with at least a slight incline in the direction of distal end 20D and outfall body 10. This incline, in conjunction with vent 27, enhances efficient filling, venting, and discharge of discharge chamber 20 into outfall body 10.

Optionally, in some environments, the present invention may include a system for hydroelectric generation of power (not shown) within the path of water flow, such as a turbine or propeller known in the art, which is driven during discharge of discharge chamber 20. Any power generated could be stored for emergency use, possibly as control power for actuation of valves and sensors.

Figure 3:
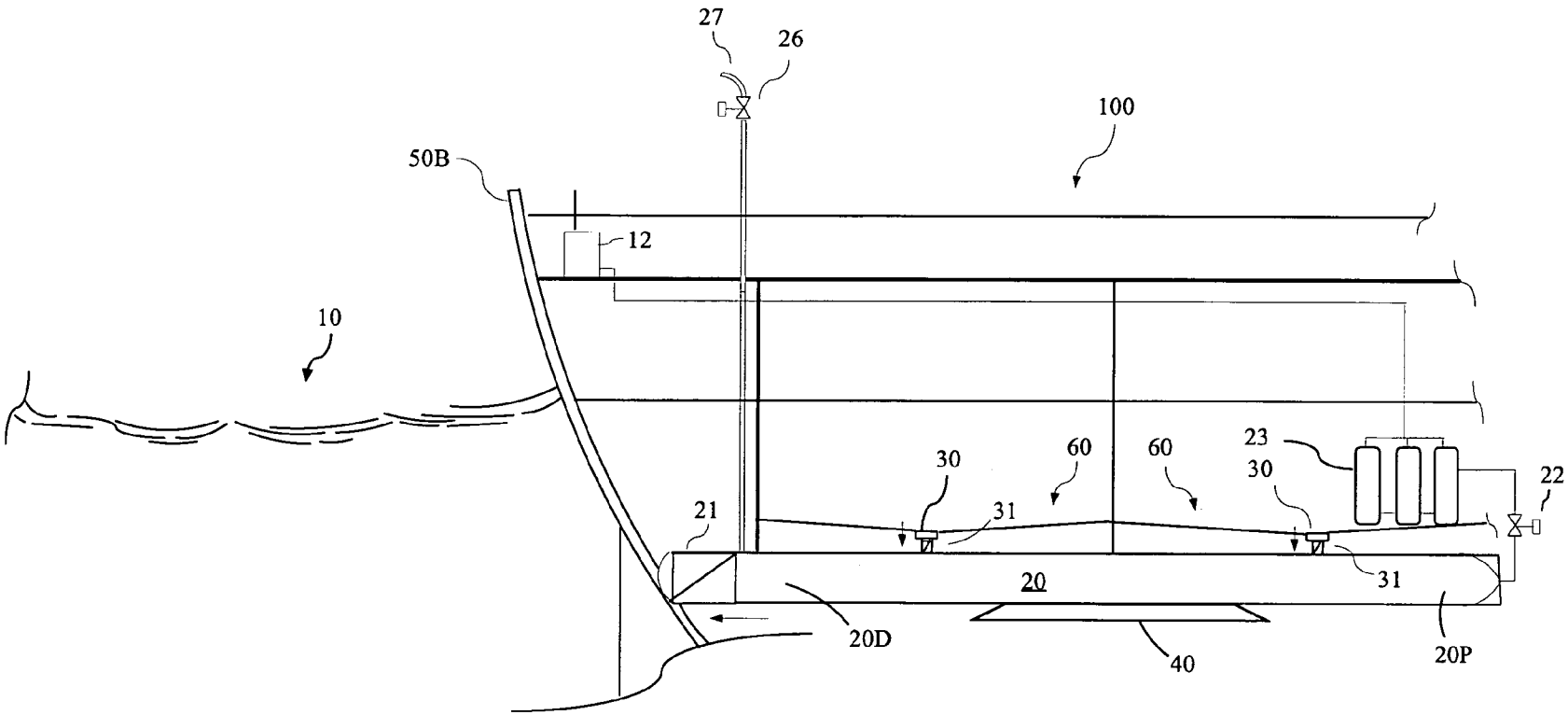
FIG. 3 is a side view schematic of an embodiment of the present invention for dewatering an area aboard a water craft.

FIG. 3 shows another embodiment of the present invention. In this example, the present invention is installed on a water craft or vessel 100, such as a ship or submarine, in which the surrounding water may comprise outfall body 10. Bulkheads 50B separate outfall body 10 from interior spaces of vessel 100. Anchor 40 affixes discharge chamber 20 to vessel 100 in a desired orientation. Drainage area 60 are those spaces desired to be pumped, typically bilges, which are lower areas in the inner hull (i.e., possibly excluding tanks or other bottom hull structures.) This example demonstrates gravity fill of discharge chamber 20 via catch basins 30, via drainage check valves 31. Optionally, discharge chamber 20 may be filed by a separate pumping system, if desired (not shown). Because of variations in orientation due to pitch, roll, or yawl of vessel 100, it may be desirable to install multiple vents 27 along discharge chamber 20, which would also enable a more horizontal orientation of discharge chamber 20. Further, for marine use, muzzle check valve 21 is preferably marine quality and may include separate or redundant isolation valves or check valves. As shown, air compressor 12 may be a common compressor located remotely and serving systems in addition to the present invention. Further, accumulator 23 may be configured in a bank to provide long term capacity for the purpose of safety; dewatering of a vessel may be critically important in a severe flooding casualty. Of course, those skilled in the art will acknowledge that standard modifications for afloat use may be appropriate—such as the ability to lock out control valve 22 during certain operations of vessel 100, redundant supporting systems, use of materials suitable for the corrosive marine environment, or use of larger air pipes at the point of connection with discharge chamber 20 to avoid freezing while compressed air expands into discharge chamber 20, etc.

Optionally, some shipboard embodiments may include an alternate mechanism (not shown) for water charging or filling of discharge chamber 20 in addition to catch basin 30. This may be desirable if discharge chamber 20 is configured for use as an emergency propulsive force.

The above examples should be considered to be exemplary embodiments, and are in no way limiting of the present invention. Thus, while the description above refers to particular embodiments, it will be understood that many modifications may be made without departing from the spirit thereof.

What is claimed is:

1. A dewatering system, comprising:

a catch basin adapted to collect water from an area;

an elongated discharge chamber having a muzzle at a distal end in communication with a desired outfall body and a substantially closed proximal end, wherein the muzzle includes a first backflow prevention device to prevent backflow from the outfall body into the discharge chamber while permitting discharge from the discharge chamber via the muzzle;

conduit interposed between the catch basin and the discharge chamber so as to provide fluid communication from the catch basin to the discharge chamber, wherein a second backflow prevention device is interposed between the catch basin and the discharge chamber within the conduit to ensure water communication from the catch basin solely in a direction to fill the discharge chamber;

wherein the discharge chamber further comprises a vent providing communication from the discharge chamber to atmosphere to enable the escape of air from the discharge chamber as water fills the discharge chamber;

an anchor securing the discharge chamber in a desired orientation and depth with respect to the outfall body and the catch basin;

a supply of compressed air fluidly interconnected with the proximal end of the discharge chamber;

a control valve in fluid communication with the supply of compressed air for operatively controlling the flow of compressed air into the discharge chamber; and whereby actuation of the control valve releases compressed air into the proximal end of the discharge chamber to forcibly discharge water out of the discharge chamber via the muzzle and into the outfall body to dewater the area.

2. The dewatering system of claim 1, further comprising an air compressor fluidly interconnected with the supply of compressed air.

3. The dewatering system of claim 1, wherein the vent includes a valve to prevent release of water through the vent as the discharge chamber discharges.

4. The dewatering system of claim 1, wherein the discharge chamber is oriented to include substantial horizontal travel from the proximal end to the distal end.

5. The dewatering system of claim 1, further comprising a control system for measuring the level of water within the discharge chamber and actuating the control valve when the level of water within the discharge chamber is at a desired level.

6. The dewatering system of claim 1, further comprising a pump fluidly interconnected within the conduit, configured with its input from the direction of the catch basin and its output in the direction of the discharge chamber, such that upon operation the pump will assist in filling the discharge chamber.

7. A dewatering system, comprising:

a catch basin adapted to collect water from an area;

an elongated discharge chamber having a muzzle at a distal end in communication with a desired outfall body and a substantially closed proximal end, wherein the proximal end is positioned at a depth below the catch basin and the muzzle includes a first backflow prevention device to prevent backflow from the outfall body into the discharge chamber while permitting discharge from the discharge chamber via the muzzle;

conduit interposed between the catch basin and the discharge chamber so as to provide fluid communication downwardly from the catch basin to the discharge chamber, wherein a second backflow prevention device is interposed between the catch basin and the discharge chamber within the conduit to ensure water communication from the catch basin solely in a direction to fill the discharge chamber;

wherein the discharge chamber further comprises a vent providing communication from the discharge chamber to atmosphere to enable the escape of air from the discharge chamber as water fills the discharge chamber;

an anchor securing the discharge chamber in a desired orientation and depth with respect to the outfall body and the catch basin;

a supply of compressed air fluidly interconnected with the proximal end of the discharge chamber;

a control valve in fluid communication with the supply of compressed air for operatively controlling the flow of compressed air into the discharge chamber; and whereby actuation of the control valve releases compressed air into the proximal end of the discharge chamber to forcibly discharge water out of the discharge chamber via the muzzle and into the outfall body to dewater the area.

8. The dewatering system of claim 7, further comprising an air compressor fluidly interconnected with the supply of compressed air.

9. The dewatering system of claim 7, wherein the vent includes a valve to prevent release of water through the vent as the discharge chamber discharges.

10. The dewatering system of claim 7, wherein the discharge chamber is oriented to include substantial horizontal travel from the proximal end to the distal end.

11. The dewatering system of claim 7, further comprising a control system for measuring the level of water within the discharge chamber and actuating the control valve when the level of water within the discharge chamber is at a desired level.

12. A method of dewatering a surface, comprising:

providing at least one catch basin within an area, wherein the catch basin is adapted to collect surface water from an area;

providing an elongated discharge chamber having a distal end with a muzzle in communication with a desired outfall body and a substantially closed proximal end, wherein the proximal end is positioned at a depth below the catch basin and the muzzle includes a first backflow prevention device to prevent backflow from the outfall body into the discharge chamber while permitting discharge out of the muzzle from the discharge chamber;

providing a conduit interposed between the catch basin and the discharge chamber so as to provide fluid communication downwardly from the catch basin to the discharge chamber, wherein a second backflow prevention device is interposed between the catch basin and the discharge chamber within the conduit to ensure water communication from the catch basin solely in a direction to fill the discharge chamber;

providing a vent to the discharge chamber to enable the escape of air from the discharge chamber as water fills the discharge chamber;

anchoring the discharge chamber in a desired orientation and depth with respect to the outfall body and the catch basin; and when the water in the discharge chamber reaches a desired level, releasing compressed air into the proximal end of the discharge chamber to forcibly expel the water out of the muzzle and into the outfall body to dewater the area.

* * * * *